US007856199B2

(12) United States Patent
Tomizawa

(10) Patent No.: US 7,856,199 B2
(45) Date of Patent: Dec. 21, 2010

(54) IMAGE FORMING APPARATUS

(75) Inventor: Takeshi Tomizawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/472,806

(22) Filed: May 27, 2009

(65) Prior Publication Data

US 2009/0297229 A1 Dec. 3, 2009

(30) Foreign Application Priority Data

May 29, 2008 (JP) ..... 2008-141053

(51) Int. Cl.
*G03G 15/09* (2006.01)

(52) U.S. Cl. ..... 399/274; 399/267; 399/276

(58) Field of Classification Search ..... 399/265, 399/267, 274, 276, 279, 284
See application file for complete search history.

(56) References Cited

U.S. PATENT DOCUMENTS

| | | | | |
|---|---|---|---|---|
| 6,904,245 | B2 | 6/2005 | Mochizuki et al. | |
| 7,352,985 | B2 | 4/2008 | Tomizawa | |
| 7,567,764 | B2 * | 7/2009 | Yamanaka et al. | 399/53 |
| 7,702,266 | B2 * | 4/2010 | Kazaki et al. | 399/279 |
| 2007/0110482 | A1 | 5/2007 | Kazaki et al. | |
| 2007/0140062 | A1 | 6/2007 | Punkka | 368/21 |

FOREIGN PATENT DOCUMENTS

| | | | |
|---|---|---|---|
| JP | 5-346731 | A | 12/1993 |
| JP | 9-106179 | A | 4/1997 |
| JP | 2007-140062 | A | 6/2007 |

* cited by examiner

*Primary Examiner*—Hoang Ngo
(74) *Attorney, Agent, or Firm*—Fitzpatrick, Cella, Harper & Scinto

(57) ABSTRACT

An image forming apparatus includes an image bearing member for bearing an electrostatic latent image; a rotatable developer carrying member, provided opposed to the image bearing member, for carrying a developer including toner and a carrier to a position where the developer carrying member is opposed to the image bearing member; a regulating member for regulating the amount of the developer to be carried on the developer carrying member; a driving device for rotating the developer carrying member; a controller for controlling the driving device to execute, at the time of end of image formation, a plurality of continuous operations each including acceleration of a rotational speed of the developer carrying member and deceleration thereof following the acceleration.

10 Claims, 10 Drawing Sheets

IMAGE FORMING APPARATUS

FIELD OF THE INVENTION AND RELATED ART

The present invention relates to an image forming apparatus, for example, an electrophotographic copying machine, an electrophotographic printer, etc. It also relates to a developing apparatus usable as an image forming apparatus such as the above-mentioned ones.

An electrophotographic image forming apparatus forms an electrostatic latent image on its image bearing member, and develops the electrostatic latent image into a visible image, that is, an image formed of toner, with its developing apparatus. There have been proposed dry developing apparatuses which use a developer made up of a single component, and also, dry developing apparatuses which use a developer made up of two components. Further, some of them have been put to practical use. Hereafter, the former may be referred to as a single-component developing apparatus, whereas the latter may be referred to as a two-component developing apparatus.

From the standpoint of reliability with which toner is charged, and also, from the standpoint of durability of toner, a developing apparatus, which uses a two-component developer, more specifically, a developer made up of toner, and magnetic carrier which contributes to the charging of the toner, is superior to a developing apparatus which uses a single component developer. Thus, a developing apparatus which uses a two-component developer is widely used as the developing device for an image forming apparatus which is required to be significantly more durable and higher in image quality than an ordinary image forming apparatus. In order to ensure that a developing apparatus is stable in performance in terms of the development of a latent image on an image bearing member, it is necessary to ensure that the developing apparatus is stable in the amount (preset amount) by which developer is placed in a layer on its development sleeve, that is, its developer bearing member. Thus, a developing apparatus is provided with a development blade, which is a member for controlling the amount (preset amount) by which developer is allowed to remain in a layer on the peripheral surface of the development sleeve. In terms of the direction in which a photosensitive drum, which is the latent image bearing member of an image forming apparatus, is rotated, the development blade is disposed on the upstream side of the developing position, which is the position where the distance between the photosensitive drum and development sleeve is smallest. However, a developing apparatus structured as described above suffers from the problem that when the developer in the developing apparatus is in a certain condition, toner particles 47 (FIG. 8) having separate from carrier particles are likely to agglomerate and adhere to the development blade (developer regulating member). If toner particles agglomerate into a lump 46 of toner particles and adhere to the development blade (FIGS. 7 and 8), the amount by which developer is allowed to remain on the development sleeve (developer bearing member) becomes unstable, resulting sometimes in the formation of an image which is abnormal in density.

In particular, as developer increases in the weight ratio of the toner therein, it increases in the ratio of the nonmagnetic toner to the magnetic carrier, making it impossible for the magnetic carrier to retain all the nonmagnetic toner. In other words, the developer increases in the amount of so-called free toner. Further, with the increase in the length of time the developing apparatus is used for development, the toner reduces in the amount of the external additives which are on the surface of each toner particles; the deteriorated toner increases.

Thus, various solutions for the above-described problem have been proposed. One of the proposals is disclosed in Japanese Laid-open Patent Application H09-106179. According to this proposal, the developer regulating member is given microscopic vibrations to prevent the toner from agglomerating on the development blade. Another proposal is disclosed in Japanese Laid-open Patent Application H05-346731, which relates to an image forming apparatus which uses a two-component developer. According to this patent application, in order to recover the developer on the portion of the development sleeve, which is facing the photosensitive drum after the completion of the development of a latent image, the developing apparatus is structured so that while an image is not formed, the development sleeve is rotated in the opposite direction from the direction in which it is rotated for latent image development.

However, the structural arrangement disclosed in Japanese Laid-open Patent Application H09-106179 requires an electric power source dedicated to the microscopic vibrations of the developer regulating member. Thus, it increases the developing apparatus in component count, increasing thereby the developing apparatus in cost. Further, the structural arrangement disclosed in Japanese Laid-open Patent Application H05-346731 is simply for recovering the developer on the development sleeve into the developing device itself, being therefore not satisfactory to prevent the toner agglomeration on the development blade.

SUMMARY OF THE INVENTION

Thus, the primary object of the present invention is to provide an image forming apparatus which uses two-component developer, more specifically, developer made up of a magnetic carrier and nonmagnetic toner; is simple in structure; and yet, does not output a defective image, the defects of which are attributable to the adhesion of lumps of toner particles resulting from the agglomeration of the toner particles, to the regulating member for regulating thickness of the toner layer on the peripheral surface of the developer bearing member.

According to an aspect of the present invention, there is provided an image forming apparatus comprising an image bearing member for bearing an electrostatic latent image; a rotatable developer carrying member, provided opposed to said image bearing member, for carrying a developer including toner and a carrier to a position where said developer carrying member is opposed to said image bearing member; a regulating member for regulating the amount of the developer to be carried on said developer carrying member; a driving device for rotating said developer carrying member; a controller for controlling said driving device to execute, at the time of an end of image formation, a plurality of continuous operations each including acceleration of a rotational speed of said developer carrying member and deceleration thereof following the acceleration.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

[Overall Structure of Image Forming Apparatus]

Figure 1:
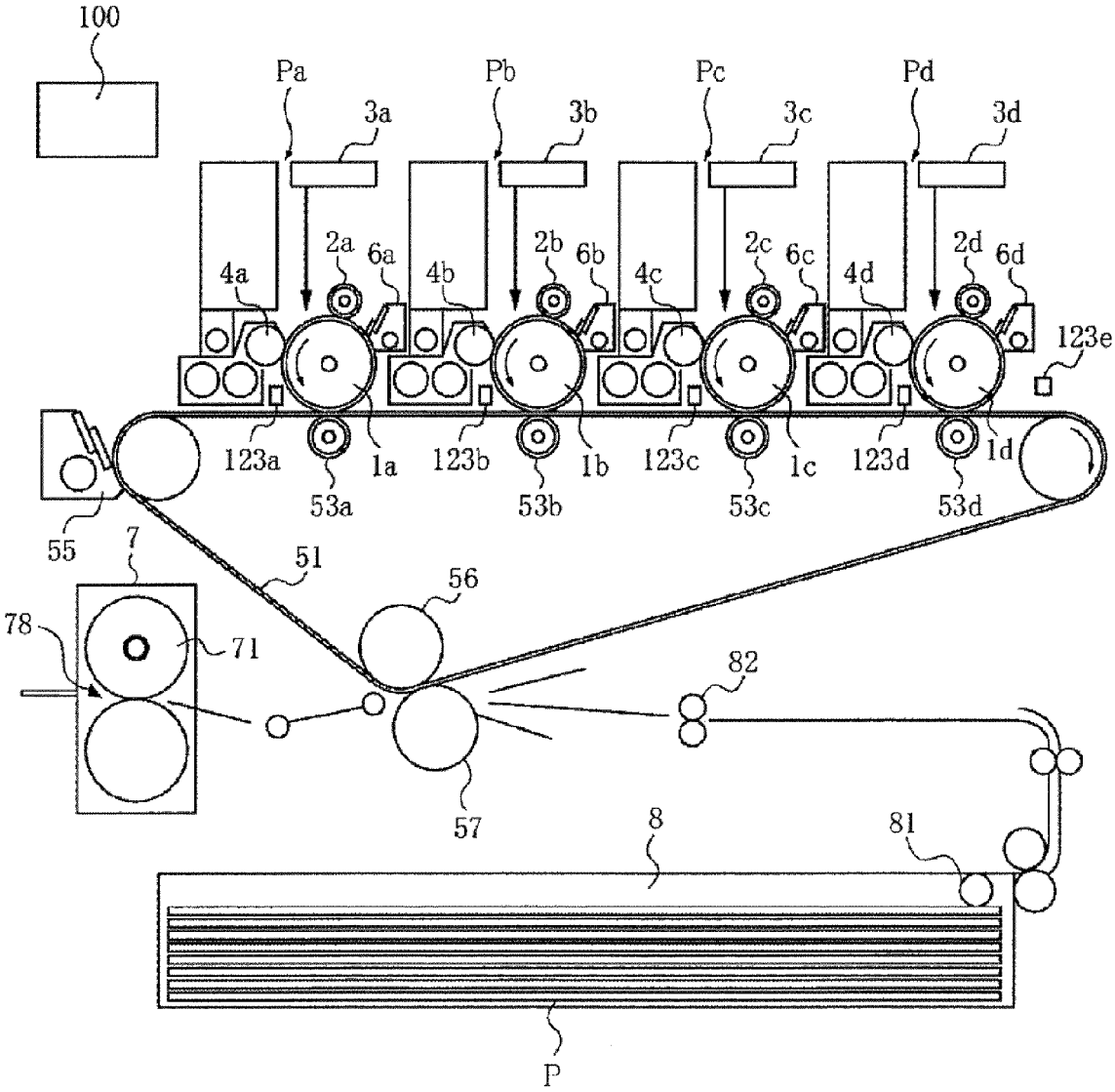
FIG. 1 is a schematic sectional view of the image forming apparatus in the first preferred embodiment of the present invention.

Referring to FIG. 1, the image forming apparatus in this embodiment has four image forming portions Pa, Pb, Pc, and Pd, which are placed in tandem in a straight line. The image forming portions Pa, Pb, Pc, and Pd are roughly the same in structure. Thus, their structure will be described referring to the image forming portion Pa.

The image forming portion Pa is provided with a photosensitive drum la (image bearing member). It is also provided with a corona-based charging device 2*a*, an exposing apparatus 3*a* (exposing means), a developing apparatus 4*a* (developing means), a transfer roller 53*a* (transferring means), and a cleaning blade 6*a* (cleaning means), which are disposed in the adjacencies of the peripheral surface of the photosensitive drum 1*a*, in the listed order in terms of the direction (indicated by arrow mark) in which the photosensitive drum 1*a* is rotated.

Four toner images formed by the image forming portions Pa, Pb, Pc, Pd are transferred in layers onto an intermediary transfer belt 51, and then, are transferred together onto a sheet of recording medium P by a secondary transfer roller 57 (transferring means). Located immediately on the downstream side of the secondary transfer roller 57 in terms of the direction in which the recording medium P is conveyed is a fixing apparatus 7 (fixing means).

[Photosensitive Drum (Image Bearing Member)]

The image forming apparatus in this (first) embodiment is provided with the photosensitive drum 1 (image bearing member), which is an electrophotographic photosensitive member in the form of a rotatable drum. The photosensitive drum 1 is provided with a photosensitive layer formed of an OPC (organic photosensitive semiconductor), which is negative in default polarity. The photosensitive drum 1 is 84 mm in diameter, and is rotated about its axial line (not shown) in the direction indicated by an arrow mark at a process speed (peripheral velocity) of 300 mm/sec. The photosensitive drum 1 is made up of an electrically conductive substrate and three functional layers, more specifically, an undercoat layer, a charge generation layer, and a charge transfer layer. The substrate is in the form of a drum. The three functional layers are coated in layers on the peripheral surface of the substrate, in the listed order. The under coat layer is for suppressing optical interference, and also, for preventing the upper layers from separating from the substrate. Among the three functional layers, the charge generation layer and charge transfer layer make up the photosensitive layer.

[2] Charging Apparatus

The image forming apparatus shown in FIG. 1 has charge rollers 2(*a-d*) as charging means. It also has voltage applying means (not shown) for applying voltage to the charge rollers 2. The charge rollers 2 are members for uniformly charging the peripheral surface of the photosensitive drum 1 to preset polarity and potential level across the portion which is in the preset area. In this embodiment, the voltage applying means is controlled so that the peripheral surface of the photosensitive drum 1 is uniformly charged to 600 V.

[3] Exposing Apparatus (Information Writing Means)

The image forming apparatus depicted in FIG. 1 is provided with exposing apparatuses 3(*a-d*), which are the information writing means for forming an electrostatic latent image on the charged photosensitive drum 1. Each exposing apparatus 3 in this embodiment is a laser beam scanner which uses a semiconductor laser. The exposing apparatus 3 outputs a beam of laser light while modulating the beam of laser light with the image formation signals sent to the main assembly of the image forming apparatus from an image reading apparatus (not shown) or the like. More specifically, the beam of laser light is moved in a manner to scan the peripheral surface of the photosensitive drum 1, which has just been charged and is being rotated, at the exposing position. Thus, numerous points of the uniformly charged area of the peripheral surface of the photosensitive drum 1 reduce in potential level. As a result, an electrostatic latent image, which reflects the above-mentioned information of an image to be formed, is effected on the peripheral surface of the photosensitive drum 1.

[4] Developing Apparatus

The developing apparatuses (devices) 4(*a-d*), which are developing means, develop an electrostatic latent image on the photosensitive drum 1 into a visible image (toner image) by supplying the electrostatic latent image with developer (toner). The developing apparatus 4 in this embodiment is of the so-called magnetic brush type. That is, it uses a two-component magnetic developer. The image forming apparatus is structured so that multiple (four) electrostatic latent images can be developed with multiple (four) monochromatic toners, different in color, one for one. Next, referring to FIG. 4, the developing apparatuses 4 in this embodiment will be described in more detail.

A developing means container (also referred to as a developer container) 40M has a development chamber 49, in which developer is stored and stirred. Each developing apparatus 4 is provided with a development sleeve 45M (developer bearing member), which is located across the opening of the development chamber 49. The two-component developer in the development chamber 49 is a mixture of toner and magnetic carrier, and is stirred by a pair of developer stirring members 42 and 43. The magnetic carrier used by the developing apparatus in this embodiment is roughly $10^{13}$ Ω·cm in electrical resistance, and 40 μm in particle diameter. The toner is negatively charged by the friction between the toner and magnetic carrier. The toner used by the developing apparatus in this embodiment is adjusted in cohesiveness with the use of external additives and/or by controlling the shape of the toner particle; it has been adjusted to 40 degrees or so in cohesiveness. It has been known that if toner is excessively low in cohesiveness, it easily shifts, being therefore likely to cause an image forming apparatus to form an image which is defective in that it appears as if it were sprinkled with toner after its formation, an image which is defective in that it appears as if it were covered with polka dots (attributable to separative discharging of static electricity to image bearing member, or the like discharge), or an image which is defective in that it has abnormal radial streaks. On the other hand, if toner is excessively high in cohesiveness, it also creates problems: for example, it creates problems while it is conveyed, or is likely to cause an image forming apparatus to form an image, the center portion of which is missing as if it were eaten by a moth or the like.

The development sleeve 45M, which is a developer bearing member, is positioned in parallel to the photosensitive drum 1 in such a manner that the shortest distance (S-Dgap) between the peripheral surface of the development sleeve 45M and that of the photosensitive drum 1 is 350 μm. This area in which the distance between the photosensitive drum 1 and development sleeve 45M is shortest is the development portion. The development sleeve 45M is rotated in such a direction that its peripheral surface moves in the same direction as the moving direction of the peripheral surface of the photosensitive drum 1. That is, the development sleeve 45M is rotated in the direction indicated by an arrow mark C whereas the photosensitive drum 1 is rotated in the direction indicated by an arrow mark A.

A part of the body of two-component developer in the developing means container 40M is adhered and held to the peripheral surface of the development sleeve 45M in a layer (magnetic brush layer) by the magnetic force of a magnetic roller 41 disposed within the development sleeve 40M. Thus, as the development sleeve 45M is rotated, the two-component developer on the peripheral surface of the development sleeve 45M moves with the peripheral surface of the development sleeve 45M. As the development sleeve 45M is rotated, the magnetic brush layer is smoothed by a developer coating blade 44 into a thin and uniform layer of developer with a predetermined thickness. As the development sleeve 45M is rotated further, this thin layer of developer comes into contact with the peripheral surface of the photosensitive drum 1, and rubs the peripheral surface of the photosensitive drum 1 as it is moved through the development portion.

To the development sleeve 45M, a development bias is applied from an electrical power source (not shown), while being controlled by a CPU 100 (controlling means). In this embodiment, the development bias to be applied during a normal image forming operation is set so that its DC component Vdc is −450 V, and AC component is 1.8 kVpp (it is blank pulse, and is 12 kHz in frequency). "Blank pulse" is such a pulse that each cycle is made up of a period in which both the AC and DC voltages are applied together, and a period (blank period) in which only the DC voltage is applied. As the development bias is applied to the development sleeve 45M, the electrostatic latent image on the photosensitive drum 1 is developed into a visible image formed of toner (toner image). In the case of this embodiment, the toner is adhered to the exposed points (points illuminated by beam of laser light) of the photosensitive drum 1; that is, the electrostatic latent image is developed in reverse.

To summarize, as the development sleeve 45M is rotated, the developer in the developing means container 40M of the above-described developing apparatus 4 is coated in thin layer on the peripheral surface of the development sleeve 45M, and is conveyed to the development portion, in which the toner in the developer on the peripheral surface of the development sleeve 45M is adhered to the selected (exposed) points of the electrostatic latent image on the photosensitive drum 1, by the electric field generated by the development bias applied to the development sleeve 45M by the development bias application power source.

The toner adhered to the photosensitive drum 1 is −25 μC/g in the amount of charge.

The portion of the body of developer which was not used for the development is conveyed by the magnetic pole N1 of the magnetic roller 41 back into the developing means container 40M, and falls into (is recovered by) the developing means container 40M due to its own weight, by the time it reaches the mid point between the magnetic poles N1 and N2 which are opposite is polarity.

In this embodiment, in order to maintain the two-component developer in the developing means container 40M (more specifically, development chamber 49) so that the toner density of the developer remains roughly in a preset range, a referential toner image (patch) is formed on the photosensitive drum 1, during a period which is correspondent to one of the recording sheet intervals, with the development contrast Vcont set to a predetermined value. That is, the toner density of the two-component developer in the developing means container 40M is detected by detecting the image of the patch (referential toner image) with the use of an optical toner density sensor (not shown), for example. If it is determined that the toner density is below the above-mentioned proper range, a target level for the toner density ratio T/D is increased in value to increase the amount by which toner is supplied to the developing device 4 from the toner hopper (unshown toner supplying means). As the developing device 4 is supplied with a fresh supply of toner, the toner density ratio T/D increases, which in turns reduces, in the amount of charge, the toner in the developing device 4. Thus, as the developing device 4 is supplied with a fresh supply of toner, a control is executed to keep constant the toner density relative to the preset development contrast Vcont. On the contrary, if it determined that the toner density is above the above-mentioned proper range, the delivery of the toner to the developing device 4 is temporarily halted. Here, "development contrast Vcont" means the difference |Vdc−V1| between the potential level V1 of the exposed areas of photosensitive drum 1 after the exposure of the charged photosensitive drum 1 for the formation of a latent image on the photosensitive drum 1, and the potential level Vdct of the development sleeve 45M. Regarding the method used for supplying the developing apparatus with toner, the developing apparatus 4 in this embodiment is supplied with such a developer that is a mixture of toner and magnetic carrier, and the old and excessive portion of the developer in the developing apparatus 4 is trickled out of the developing device through an developer outlet (not shown) with which the developing device is provided.

Figure 4:
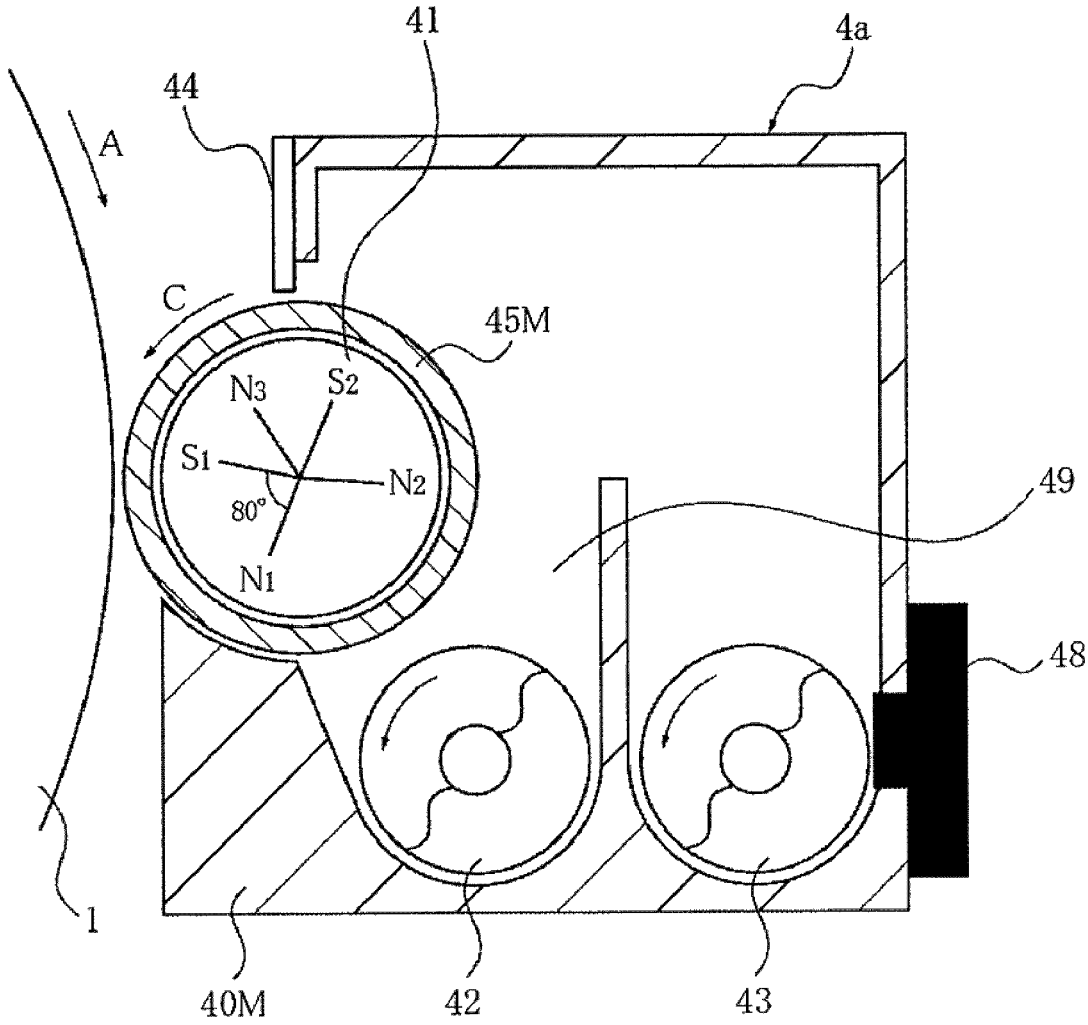
FIG. 4 is a schematic sectional view of the developing device.

Next, the method, in this embodiment, for detecting the toner density ratio T/D (ratio between toner and magnetic carrier) of the two-component developer in the development chamber 49 will be described. In this embodiment, the inductance detecting method is used to detect the toner density ratio T/D. The inductance detecting method determines the actual toner density ratio of the developer in the developing device by detecting the apparent magnetic permeability, which reflects mixing ratio between the magnetic carrier and non-magnetic toner. The amount by which toner is to be supplied to the developing device is determined by the comparison of the detected toner density ratio with a referential value. In this embodiment, in order to detect the apparent magnetic permeability, the developing device is provided with an inductance head 48, which is attached to one of the side walls of the developing device, as shown in FIG. 4.

The image forming apparatus is structured so that the results of the detection is inputted into an $E^2$ROM (not shown). More specifically, if it is detected that the apparent magnetic permeability of the developer is greater than the referential value, it means that the ratio of carrier particles in a specific volume of developer has become greater than the referential value; the developer has reduced in toner density. On the other hand, if the detection signal is smaller in value than the referential value, that is, if it is detected that the developer has reduced in the apparent magnetic permeability, it means that the developer has reduced in the ratio of carrier in the preset volume of developer; the developer has increased in toner density. The inductance detecting method is problematic in that even if the developer does not change in toner density, the sensor output is affected by the change in the apparent density of the developer itself, making it impossible to accurately control the developer in terms of toner density. In this embodiment, therefore, the toner density detected by the inductance detection method is compensated according to (1) changes having occurred to the developer due to its cumulative usage, (2) operational condition of the image forming apparatus, (3) ratio of the toner-covered area of the image being made, and (4) amount of the triboelectric charge of the toner (predicative control), to improve the accuracy with the magnetic permeability is detected. Not only is the inductance detection method inexpensive in terms of a sensor itself, but also, it is not affected by the spatial issues, and also, the problems related to the soiling attributable to the scattering of toner. Thus, it may be said that the inductance detection method is the most suitable toner density detecting method for an image forming apparatus which is low in cost and small in size.

[5] Transferring Means

In this embodiment, the primary transfer rollers 53(*a-d*) are used as the transferring means. Each of the primary transfer rollers 53(*a-d*) is kept pressed against the peripheral surface of the corresponding photosensitive drum 1 with the application of a predetermined amount of pressure, with the presence of an intermediary transfer belt 51 between the photosensitive drum and primary transfer roller 53, forming a compression nip between the peripheral surface of the photosensitive drum 1 and the intermediary transfer belt 51. This compression nip serves as the transfer portion. To the transfer portion, the recording medium P (sheet of paper, transparent film, etc.) is delivered from a sheet feeding mechanism (not shown) with a preset control timing.

As the recording medium P arrives at the transfer portion, it is conveyed between the photosensitive drum 1 and transfer roller 53, which are being rotated, while remaining pinched between the two. While the recording medium P is conveyed through the transfer portion (nip), a positive transfer bias (+2 kV in this embodiment), which is opposite in polarity from the normal polarity to which the toner is charged, is applied to the transfer roller 51 from a transfer bias application power source (not shown). As a result, the toner images on the peripheral surfaces of the photosensitive drums 1 are electrostatically and sequentially transferred in layers onto the intermediary transfer belt 51 (image bearing member). The intermediary transfer belt 51 is suspended by multiple rollers by which it is stretched. It is made of an electrically conductive film, for example, polycarbonate film, polyethylene terephthalate resin film, polyfluorovinylidene resin film, etc., or a dielectric resin. The intermediary transfer belt 51 in this embodiment is formed of a dielectric polyimide. Regarding the delivery of the recording medium P, the recording medium P is picked out of the recording medium feeder cassette 8 by a pickup roller 81, and is conveyed to a pair of registration rollers 82. As the recording medium P reaches the pair of registration rollers 82, the pair of registration rollers 82 temporarily halt the recording medium P by the leading end of the recording medium P to control the recording medium delivery timing so that the image(s) on the intermediary transfer belt 51 will be transferred onto the recording medium P across a preset area of the recording medium P.

As the recording medium P and the four layers of monochromatic toner images, different in color, are conveyed through the nip between the secondary transfer roller 57 and intermediary transfer belt 51, the four toner images are transferred together onto the recording medium P by the secondary transfer roller 57. There is a cleaning apparatus 55 (cleaning means) for cleaning the intermediary transfer belt 51, which is placed in contact with the intermediary transfer belt 51 to remove the transfer residual toner on the intermediary transfer belt 51. The cleaned portion of the intermediary transfer belt 51 is used for the next cycle of image formation; the intermediary transfer belt 51 is repeatedly used for image formation.

[6] Fixing Means

After the transfer of the toner images onto the recording medium P by the secondary transfer roller 57, the recording medium P is separated from the intermediary transfer belt 51 as if it is peeled away from the intermediary transfer belt 51. Then, the recording medium P is conveyed to the fixing apparatus 7, which is made up of a fixation roller 71 and a pressure roller 72. Then the recording medium P is conveyed through the fixing apparatus 7. As the recording medium P is conveyed through nip 72 formed by the fixation roller 71 and pressure roller 72, the recording medium P and the toner images thereon are heated and pressed. As a result, the toner images are fixed to the surface of the recording medium P. Thereafter, the recording medium P is outputted as a print (copy). In order to facilitate the separation of the recording medium P from the fixation roller 71, the fixing means 7 is provided with a mechanism for coating the surface of the fixation roller 71 with separation oil (for example, silicone oil). Thus, this oil adheres to (transfers onto) the recording medium P. After the fixation of the toner images to the recording medium P, the recording medium P is discharged into a delivery tray (not shown). When the image forming apparatus is in the mode for automatically forming an image on both surfaces of the recording medium P, the recording medium P is conveyed through the recording medium reversal path (not shown), and then, the above-described image formation sequence is repeated to form an image on the back side of the recording medium.

[Intermittent Microsecond Driving Mode]

Next, an operation mode, which characterizes the present invention, will be described. This operational mode, hereafter, may be referred to as "intermittent microsecond driving mode". When the image forming apparatus is operated in this mode, the length of time, and/or number of times, the development sleeve is rotated, is varied according to the detected toner density ration T/D (ratio, in weight, of toner relative to developer).

Figure 5:
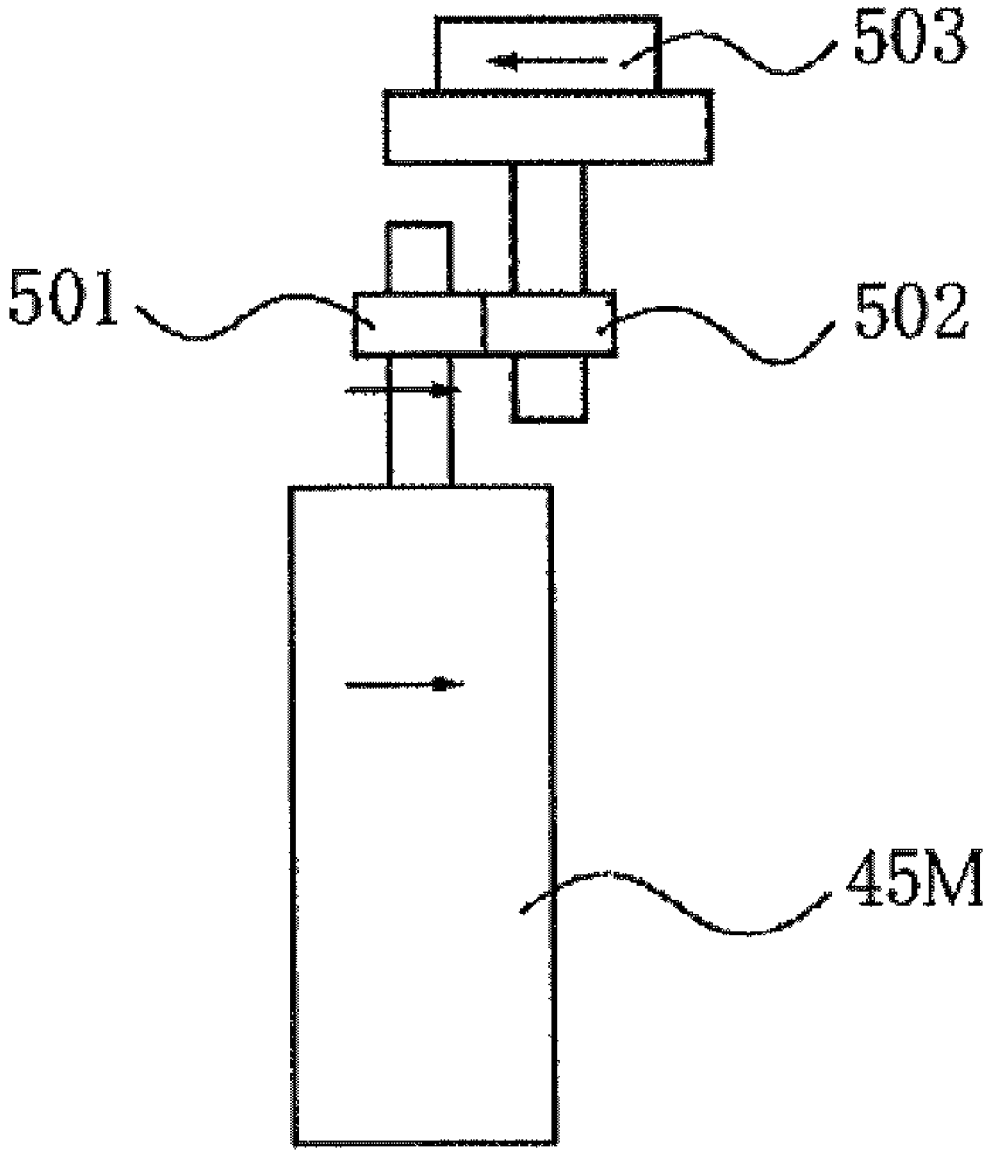
FIG. 5 is a schematic top plan view of the developing device driving mechanism.

Referring to FIG. 5 which is a top plan view of the developing device driving portion, the shaft of the development sleeve 45M is fitted with a gear 501 through which the mechanical force for driving the developing device is transmitted to the developing device. The developing device driving gear 501 is in mesh with a gear 502, with which the apparatus main assembly is provided to drive the developing device (development sleeve 45M). The gear 502 is solidly attached to the shaft of the developing device driving motor 503. It transmits the driving force of the developing device driving motor 503 to the developing device (gear 501). The motor 503 is a stepping motor, which can quickly respond to an on- or off-signal.

When the image forming apparatus is in the normal image formation mode, the developing device driving motor 503 is driven in the direction indicated by an arrow mark at a preset speed. However, it is designed so that it can be operated in the so-called intermittent microsecond driving mode when the image forming apparatus is not making an image. The intermittent microsecond driving mode, which characterizes the present invention, is such a mode that intermittently stops the rotation of the development sleeve 45M two or more times while no image is formed. More specifically, the intermittent microsecond driving mode is such an operational mode that the speed at which the development sleeve 45M is driven is switched two or more times between the first and second speeds. The second rotational speed may not be 0; the development sleeve 45M does not need to be stopped. That is, the CPU controls the developing device driving motor 503 in such a manner that a sequence in which the development sleeve is increased in rotational speed and decreased is repeated two or more times with preset intervals. Here, the sequence in which the development sleeve is increased in rotational speed and decreased means the sequence which starts from when the development sleeve begins to be increased in rotational speed, and ends when the deceleration of the development sleeve ends. This sequence is repeated two or more times. The CPU controls the image forming apparatus so that each image forming portion is operated in this mode during the interval between two jobs. More concretely, referring to FIG. 6, as soon as one image forming job ends (as soon as final developing operation of developing apparatus in given job ends), the developing means driving motor is rotated for 500 msec, in the same direction as the direction in which it is rotated for the normal image forming operation. Then, the motor is kept stationary for 500 msec. This combination of 500 msec of rotational period and 500 msec of stationary period makes up a single sequence. This sequence is continuously repeated two or more times. That is, in this embodiment, as soon as the last developing operation of the developing apparatus is ended in a given image forming job, the developing sleeve in each image forming portion is increased in rotational speed, and then, is decreased in rotational speed, twice or more times, while rotating the development sleeve in the same direction as it is rotated in an image forming operation. Intermittently driving the development sleeve for microseconds twice or more times can continuously vibrate the agglomerated toner particles, and therefore, it can efficiently disperse the agglomerated toner particles. Although the direction in which the development sleeve is driven in the intermittent microsecond driving mode in this embodiment is the same as the direction in which the development sleeve is driven during the normal image forming operation, it may be opposite from the normal direction. However, the structuring the developing apparatus (image forming apparatus) so that the direction in which the development sleeve is driven during the intermittent microsecond driving mode is the same as the normal direction is more efficiently disperse the agglomerated toner particles than the structuring the developing apparatus so that the direction in which the development sleeve is driven in the intermittent microsecond driving mode is opposite from the normal direction, because the former has an effect that the loose toner particles are made to collide with the toner particles having agglomerated on the back side of the blade, in addition to the aforementioned effect.

Figure 6:
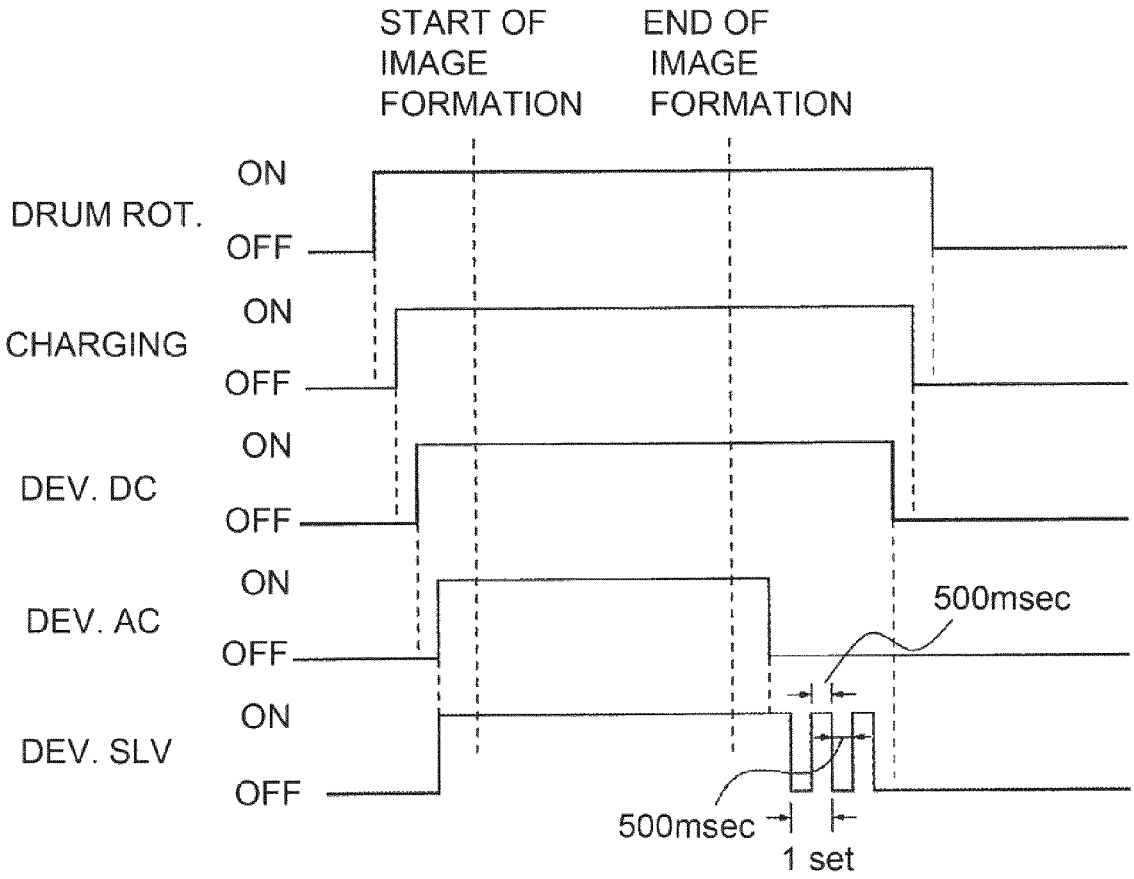
FIG. 6 is a diagram for describing the intermittent microsecond driving of the development sleeve.
Figure 7:
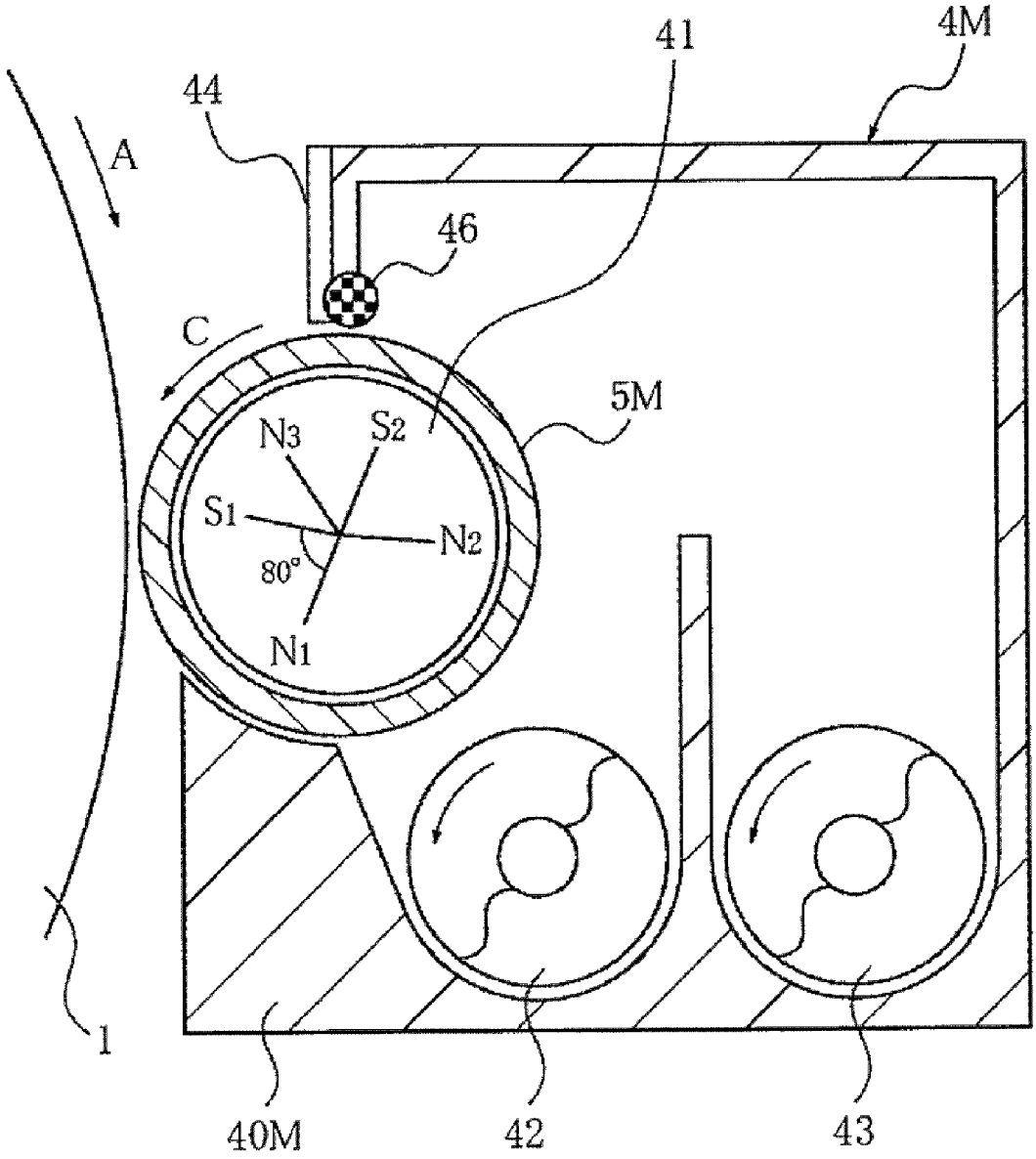
FIG. 7 is a schematic sectional view of the developing device after the agglomeration of the toner on the development blade.
Figure 8:
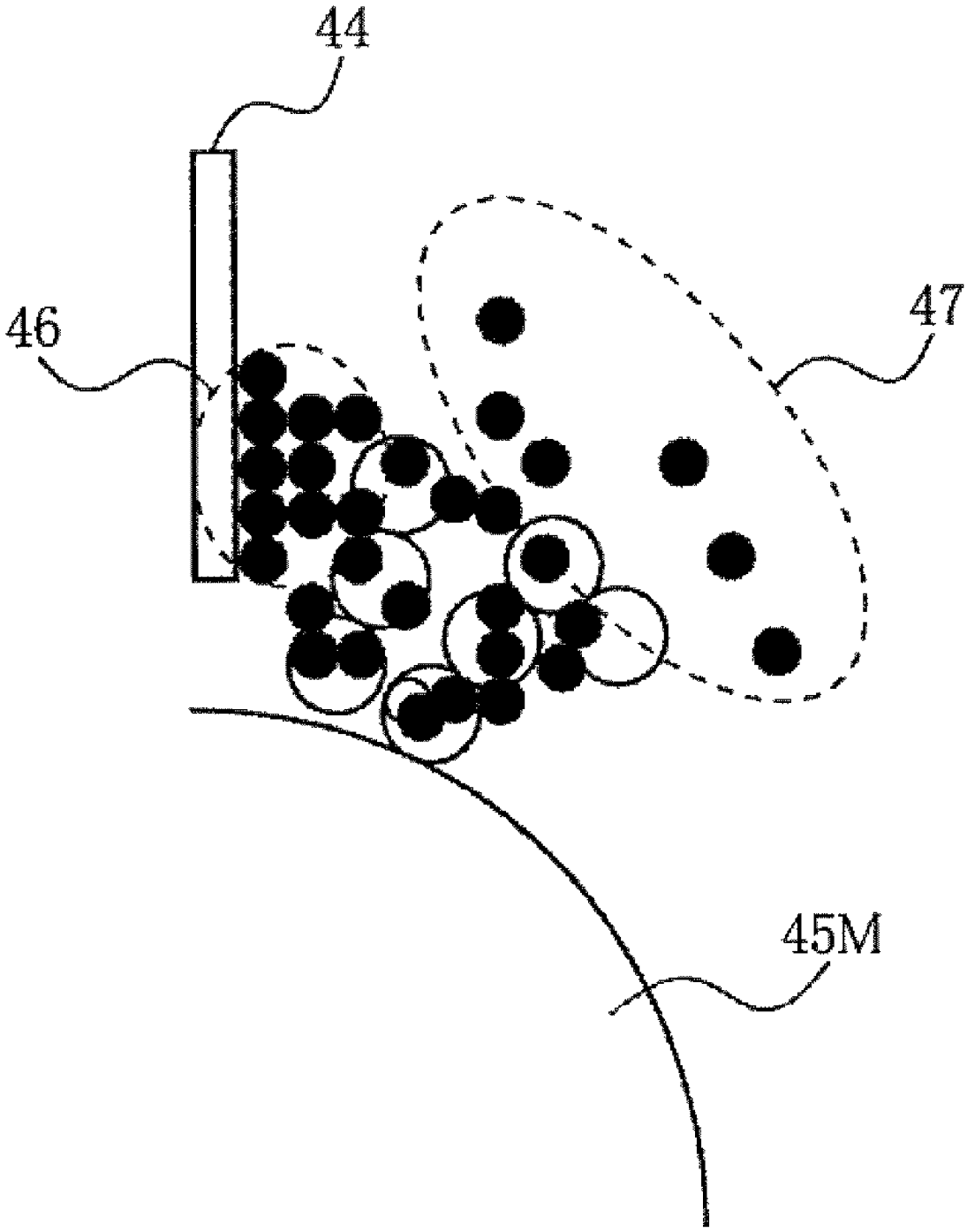
FIG. 8 is a schematic drawing which depicts the agglomeration of the free toner particles.
Figure 10:
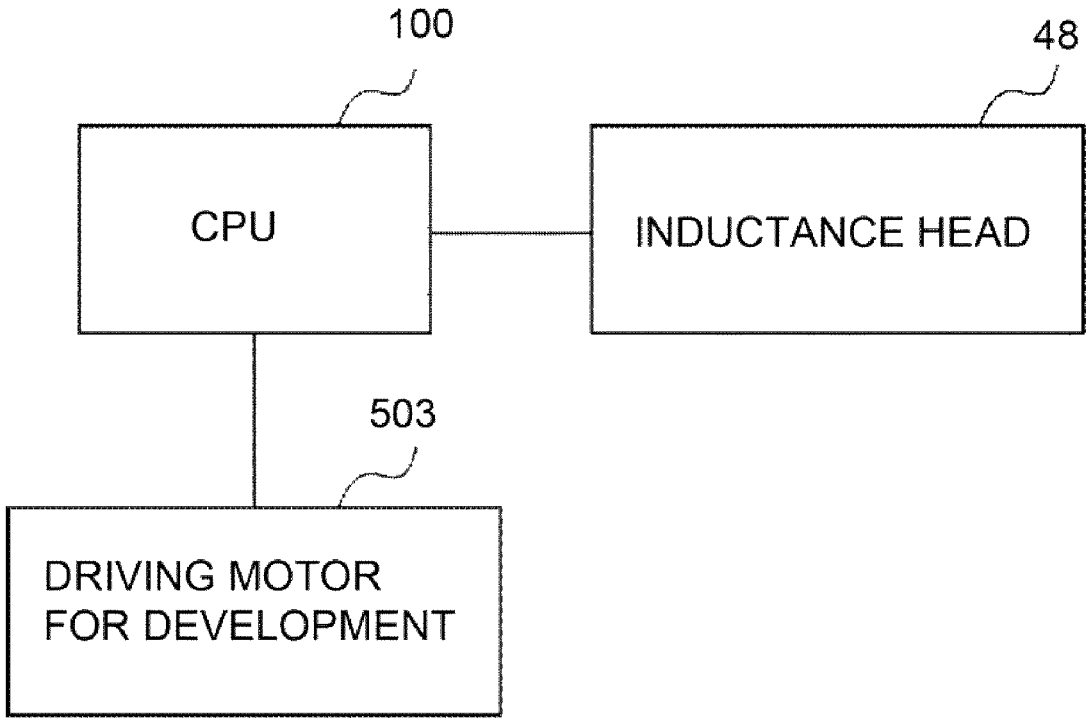
FIG. 10 is a block diagram of the mechanism for intermittently driving the development sleeve for microseconds.

Next, referring to FIG. 6, the image formation sequence of the image forming apparatus in this embodiment is described. First, the rotation of the photosensitive drum is started. Immediately thereafter, the photosensitive drum is charged with the use of the charging means so that the surface potential of the photosensitive drum reaches a preset level. Then, a DC voltage is applied to the development sleeve, and roughly at the same time, the rotation of the development sleeve and the application of AC bias to the development sleeve are started, to develop the electrostatic latent image on the photosensitive drum into a toner image. After the completion of the formation of the toner image on the photosensitive drum, the AC voltage is turned off. Then, the development sleeve is intermittently rotated for 500 msec, with 500 msec intervals, to cause the lumps of toner, in which toner particles are about to agglomerate, to collapse, or to cause it to spit out the toner particles. The reason for keeping the AC voltage of the development bias turned off while the development sleeve is intermittently driven is for preventing toner from adhering to the drum. Further, the reason for keeping the DC voltage on is for preventing carrier adhesion. After the completion of the operation of the image forming apparatus in the intermittent microsecond driving mode, the DC bias for development is turned off, and then, the charge bias is turned off. Lastly, the rotation of the photosensitive drum is stopped to end the image forming operation. FIG. 10 is a block diagram of the intermittent microsecond driving mode in this embodiment. The CPU, which functions as the developing sleeve driving controlling means, operates the image forming apparatus in the intermittent microsecond driving mode, with a preset timing, to control the driving of the development sleeve by the developing means driving motor 503.

Table 1 shows the relationship among the number of times the development sleeve driving speed is switched in the intermittent microsecond driving mode, in which the image forming apparatus is operated for every preset number (which in this embodiment is 250) of continuously formed images (copies). In this embodiment, the number of times the development sleeve driving speed is switched in the intermittent microsecond driving mode is determined according to the toner density ratio (T/D). More concretely, as the toner density ratio (T/D) increases, either the number of times the development sleeve driving speed is switched in the intermittent microsecond driving mode, or the length of time the image forming apparatus is operated in the intermittent microsecond driving mode, is increased.

Figure 2:
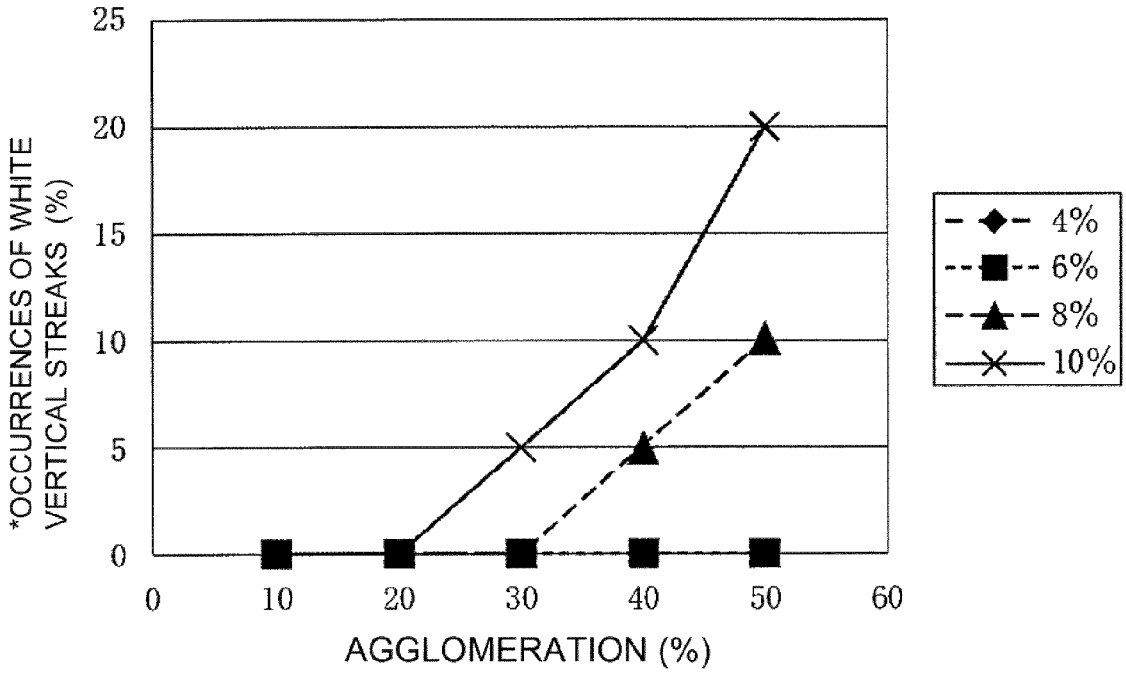
FIG. 2 is a graph showing the relationship among the toner density, degree ratio of agglomeration, and frequency with which an image suffering from abnormal white vertical streaks is formed.

The reason why the image forming apparatus is controlled as described above is as follows: The greater the toner density ratio T/D, the more likely is the toner to agglomerate, and therefore, more frequently is the image forming apparatus likely to output an image having abnormal white streaks. FIG. 2 is a graph showing the relationship between the cohesiveness of toner and the frequency with which lumps of toner particles appeared. The frequency with which the lumps of toner particles appeared was measured using the following method: a solid white image was formed on 300 sheets of A4 size, using four developers different in weight ratio of toner, which were 10%, 8%, 6%, and 4% (which is generally referred to as T/D ratio, and will be referred to as T/D ratio hereafter). Then, the first halftone image formed thereafter was evaluated; it was examined to determine whether the first halftone image had abnormal white streaks. As will be evident from FIG. 2, the greater the TD ratio, the more likely is the toner to agglomerate, and therefore, the greater the frequency with which images having abnormal white streaks are outputted (formed). Further, the image forming apparatus in this embodiment is programmed so that as the average value of the T/D ratio becomes greater than a preset value (ratio) as shown in Table 1, the image forming apparatus is operated in the intermittent microsecond driving mode as soon as the ongoing image forming operation is completed, whereas while the average value of the T/D ratio remains below the preset value (ratio) during an image forming operation in which a substantial number of images are continuously formed, the image forming apparatus is not operated in the intermittent microsecond driving mode after the completion of the ongoing image forming operation. More specifically, the image forming apparatus in this embodiment is programmed so that if the average value of the T/D ratio is no less than 6%, the image forming apparatus is operated in the intermittent microsecond driving mode.

TABLE 1

| | Number of sets of speed changes | | | | |
|---|---|---|---|---|---|
| | T/D Ratio = R (%) | | | | |
| | R < 4 | 4 ≦ R < 6 | 6 ≦ R < 8 | 8 ≦ R < 10 | R ≧ 10 |
| number of sets | 0 | 0 | 3 | 6 | 9 |

Table 1 means the following: When the image forming apparatus is set to continuously form no less than 250 copies, the image forming apparatus is operated in the intermittent microsecond driving mode during the post-rotation operation carried out after the completion of the image forming operation. Incidentally, the post-rotation operation operates the photosensitive drum for a preset length of time to prepare the image forming apparatus for the next image forming operation after the completion of an image forming operation. More concretely, if the average value of the T/D ratio is no less than 6% and no more than 8% during an operation in which multiple copies are continuously made, the development sleeve is intermittently driven three times for 500 msec with 500 msec intervals, in the same direction as the normal direction. The number of times the sequence is repeated is set based on the average toner density T/D and Table 1 given above. As soon as the sequence is repeated the preset number times, the image forming apparatus is stopped (post-rotation is stopped), and at the same time, the indicator of the average toner density T/D is reset. That is, whether or not the image forming apparatus is to be operated in the intermittent microsecond driving mode after the completion of an image formation job is determined based on the average value of the toner density T/D during the image forming operation. Further, how many times the rotational speed of the development roller is to be switched while the image forming apparatus is operated in the intermittent microsecond driving mode, is determined based on the average value of the T/D ratio. Here, the "average value of T/D ratio" means the value obtained by dividing the sum of the values of the T/D ratio signals sampled between the beginning and end of an image formation job, by number of samples, or the value obtained by dividing the sum of the values of the T/D ratio signals sampled during the period from the beginning of an image forming job to the completion of 250th images (copies), by the number of times the T/D ratio is measured.

In the case of an image forming operation in which no less than 250 images (copies) are continuously formed, changes which occur to the toner density ratio T/D while 250 images (copies) are continuously formed is averaged. In this embodiment, the T/D ratio is detected for every specific number of images (copies) formed, and the detected T/D ratios are temporarily stored in an ROM (storage means) (not shown). Then, the value obtained by the CPU by averaging the stored values is used as the average T/D ratio.

If this average value exceeds 6%, the image forming operation is temporarily stopped after the completion of the 250th image (copy), and then, the image forming apparatus is operated in the same manner as it is operated in the post-image formation operation. Then, the image forming apparatus is operated in the intermittent microsecond driving mode. On the other hand, if the detected toner density T/D ratio is no less than 6% and no more than 8%, the image forming apparatus is operated in the intermittent microsecond driving mode for the length of time equivalent to three microsecond intermittent driving cycles, and then, the image forming operation in the intermittent microsecond driving mode is ended. Then, the above-mentioned T/D ratio value storage is reset, and the interrupted image forming operation is restarted. Further, if the detected toner density ratio T/D is no less than 8%, but no more than 10% the image forming apparatus is operated in the intermittent microsecond driving mode for the length of time equivalent to six intermittent microsecond driving cycles. Further, if the average value of the toner density ratio T/D is no less than 8%, but no more than 10%, the image forming apparatus is operated in the intermittent microsecond driving mode for the length of time equivalent to nine intermittent microsecond driving cycles. Thereafter, the interrupted image forming operation is restarted.

Figure 9:
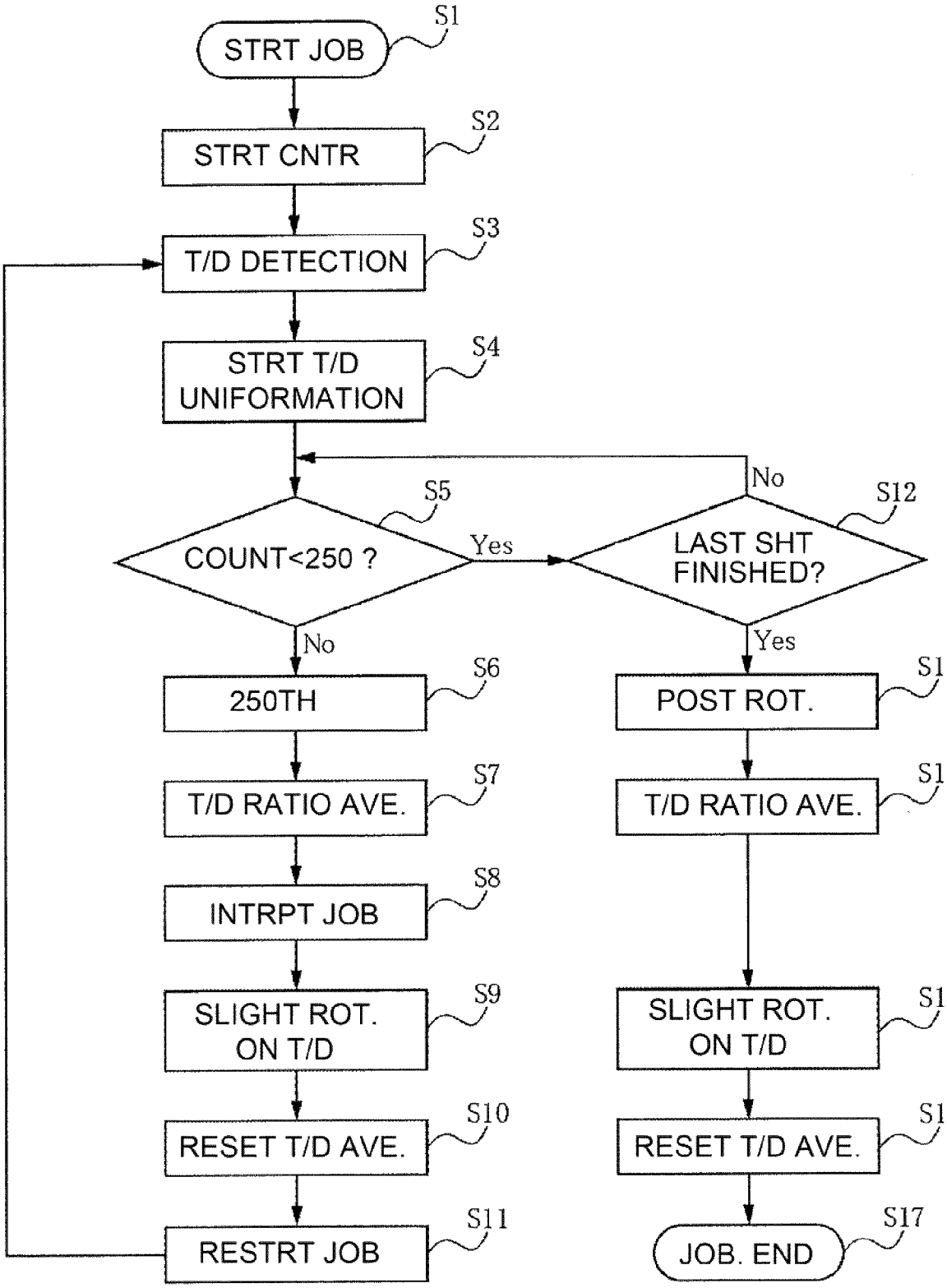
FIG. 9 is a flow chart of the image forming apparatus operation in the mode in which the development sleeve is intermittently driven for microseconds.

In a case where the average value of the detected toner density ratio T/D remains no more than 6%, the image forming apparatus is not operated in the intermittent microsecond driving mode for every 250th image (copy), that is, with an interval of 250 images (copies). However, regardless of the changes in the toner density ratio T/D, an ongoing image forming operation is interrupted once for every 2,500 images (copies), and then, is operated in the post-operation mode, to operate the image forming apparatus in the above-described intermittent microsecond driving mode. FIG. 9 is the rough flowchart of this operation. As an image formation job is started (S1), the formed images are counted by the CPU (S2). As the image formation job continues, the T/D ratio in the developing device is detected with predetermined intervals (S3), and the detected T/D ratios are stored in the ROM, while the detected TD ratios are averaged by the CPU (S4) as the T/D ratio is detected. The CPU determines whether or not the image formation count is no more than the preset value (250 images (copies)) (S5).

If the image formation count obtained in Step S5 is no more than the preset value (250), Step S6 is taken, in which it is checked if the average T/D ratio up to this point is no less than a preset value (S7). If it is no less than the preset value, the ongoing image formation job is interrupted to operate the image forming apparatus in the intermittent microsecond driving mode (S8). Then, the image forming apparatus is operated in the intermittent microsecond driving mode for a length of time which corresponds to the average T/D ratio up to this point (S9). Then, the average T/D ratio storage is reset, and the interrupted job is restarted (S10 and S11). If the image formation count is no more than the preset value (250) in Step S5, the CPU determines whether or not the last image (copy) in the current job has been completed (S12). If it is determined by the CPU in Step S12 that the image has not been formed on the last paper, Step S5 is taken again, in which it is determined again whether or not the image count is no more than the preset value (250). If it is determined in Step S12 that the image has been formed on the last paper prepared for the current job, the image forming apparatus is operated in the post-rotation mode (S13), in which it is operated in the intermittent microsecond driving mode for the length of time which corresponds to the detected T/D ratio, and then, the image formation job is ended (S14-S17).

By operating the image forming apparatus as described above, the lumps of toner particles, which result from the agglomeration of toner particles and are likely to stagnate between the development sleeve and development blade, can be removed. It should be noted here that the above-described conditions for operating the image forming apparatus in the intermittent microsecond driving mode are examples, and are not intended to limit the present invention in terms of the length of time the development sleeve is to be rotated in the normal direction, and the length of time the development sleeve is kept stationary, which is needless to say. Obviously, the above-mentioned threshold values for the toner density ratio T/D are also not intended to limit the present invention in scope.

Further, in this embodiment, the two speeds between which the rotational speed of the development sleeve is switched in the intermittent microsecond driving mode is the normal development sleeve speed for image formation and zero. However, all that is necessary is that when the image forming apparatus is in the intermittent microsecond driving mode, the rotational speed of the development sleeve is switched between two values. In other words, it is not necessary that one of the two speeds is zero. For example, the image forming apparatus in this embodiment is designed so that its process speed is 300 mm/sec, and also, that the development sleeve is rotated at the normal peripheral velocity of 450 mm/sec, which is 150% of the process speed, or a peripheral velocity of 225 mm/sec, which is half the normal process speed. Thus, the two speeds between which the rotation speed of the development sleeve is switch in the intermittent microsecond driving mode may be the 225 mm/sec and 450 mm/sec, and the effect obtained by using these two speeds will be similar to the above-described effect. As will be evident from the above given description of the first preferred embodiment of the present invention, the image forming apparatus design in accordance with the present invention can prevent the problem that as an image forming apparatus is used to continuously form a substantial number of images (copies), images having abnormal white streaks may be outputted.

Embodiment 2

The image forming apparatus in this embodiment is the same in basic structure as that in the first embodiment. Therefore, the general structure of the image forming apparatus in this embodiment will not be described.

The characteristic feature of the image forming apparatus in this embodiment is that the frequency with which the image forming apparatus is operated in the intermittent microsecond driving mode (which was described regarding the first preferred embodiment of the present invention) is changed according to the extent of the developer deterioration in the developing device (according to the amount of cumulative usage of developer in developing device). The reason for changing the frequency is that the more deteriorated the toner is in the developing device, the more likely the toner is to agglomerate, and therefore, the more frequently the toner is likely to agglomerate, making it more likely for the image forming apparatus to output unsatisfactory images as will be evident from FIG. 2.

One of the reasons why the longer the toner is used (the more deteriorated the toner), the more likely the toner is to agglomerate, is as follows: With the elapse of time, the additives (which hereafter will be referred to as external additives), which were adhered in advance to the surface of a toner particle to improve toner in fluidity, become separated from the toner particles and/or buried into the toner particles. Thus, the older toner is less fluid than the fresher toner. As for the examples of the external additive, there can be listed silicon carbide, silicon nitride, boron nitride, aluminum nitride, magnesium carbonate, organosilicon compound, in addition to such oxides as alumina, titanium oxide, silica, zirconium oxide, and magnesium oxide.

Figure 3:
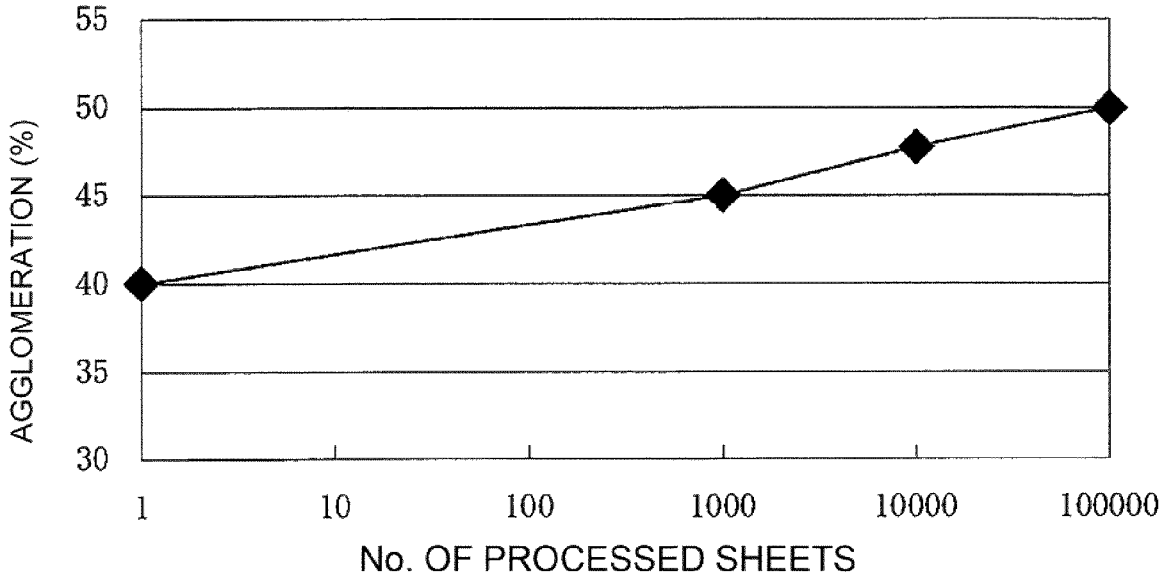
FIG. 3 is a graph showing the relationship between the cumulative number of images (copies) made and the ratio of toner agglomeration.

FIG. 3 shows the changes in the extent of the toner agglomeration which occurred during an image forming operation in which 100,000 A4 size copies of an image which is 10% in image duty (each color) are continuously formed under the normal condition (23° C. and 50% RH) As will be evident from this graph, the toner in the developing device increased in cohesiveness roughly in proportion to the number of the formed copies. That is, when the body of toner, which is 40% in cohesiveness at the beginning of an image forming operation is continuously used for image formation, it increased in cohesiveness beyond 50% as the number of continuously made copies exceeded 100,000. As a body of toner exceeds 50% in cohesiveness, the toner particles in the body of toner are likely to agglomerate, and therefore, it is likely for lumps of toner particles to collect between the development sleeve and development blade. In this embodiment, therefore, the image forming apparatus is provided with a means for cumulatively counting the number of images (copies) formed by the apparatus, and the timing (frequency) with which the ongoing image formation job is interrupted to operate the image forming apparatus in the intermittent microsecond driving mode, is changed. That is, the number of times the image forming apparatus is operated in the intermittent microsecond driving mode per preset number of images (copies) formed is increased in proportion to the cumulative number of images (copies) formed. More concretely, if the cumulative number of images (copies) formed is no more than 10,000, the timing, with which the average toner density ratio T/D is obtained in order to determine whether or not the image forming apparatus is to be operated in the intermittent microsecond driving mode, is the same as that in the first embodiment. If the cumulative number of images (copies) formed is no less than 10,000, but no more than 50,000, the average toner density ratio T/D is obtained for every 200th image (copy). If the cumulative number of images (copies) formed is no less than 50,000, but no more than 100,000, the average toner density ratio T/D is obtained for every 150th images (copies). Further, if the cumulative number of images (copies) formed is no less than 100,000, the average toner density ratio T/D is obtained for every 100 images (copies). The number of times the rotational speed of the development sleeve is switched in the intermittent microsecond driving mode in this embodiment is the same as that given in Table 1.

TABLE 2

| Integrated number of image formations (X) | Number of image formations at which micro-driving is executed |
|---|---|
| 0 < X < 10000 | 250 |
| 10000 ≦ X < 50000 | 200 |
| 50000 ≦ X < 100000 | 150 |
| X ≧ 100000 | 100 |

In the case of an image forming operation in which the number of the copies to be continuously made is no more than the referential value for switching from the actual image forming operation to the intermittent microsecond driving mode, the image forming operation is carried out as it is in the first preferred embodiment. That is, the image forming operation is not interrupted, and then, after the intended number of copies is formed, the image forming apparatus is operated in the intermittent microsecond driving mode according to Table 1. In this case, the image forming apparatus is operated in the intermittent microsecond driving mode for a length of time which corresponds to the average value of the toner density ratios T/D detected before the intended number of copies were made, instead of being operated in the ordinary post-rotation mode, and then, the image forming apparatus is stopped. That is, it is based on the average value of the toner density ratio T/D obtained while the intended number of copies are continuously made that the CPU determines whether or not the image forming apparatus is to be operated in the intermittent microsecond driving mode.

For example, if the cumulative number of images (copies) made is no more than 10,000, and the number of copies to be continuously made is no more than 250, the image forming apparatus is operated in the intermittent microsecond driving mode according to Table 1. That is, if the average value of the toner density ratio T/D is no less than 6%, but no more than 8%, the image forming apparatus is operated in the intermittent microsecond driving mode for a length of time equivalent to three intermittent microsecond driving cycles.

By operating the image forming apparatus in the above-described manner, it is possible to satisfactorily remove the lumps of toner particles resulting from the agglomeration of toner particles.

In this embodiment, the extent of the usage of the developer in the developing device is determined based on the cumulative number of the images (copies) made with the use of the developer. However, it is not mandatory that the extent of the usage of the developer is determined based on the cumulative number of the images (copies) made with the use of the developer in the developing device. For example, the extent of the usage of the developer may be determined based on the cumulative length of time the development sleeve or stirring member of the developing device, or photosensitive member, is driven for image formation. That is, it may be determined that the longer the length of time the development sleeve or stirring member of the developing device, or photosensitive drum is driven for image formation, the greater the extent of usage of the developer in the developing device (more deteriorated is developer). Further, the extent of usage of the developer in the developing device may be determined based on the cumulative length of time the image forming apparatus was used for image formation, or cumulative number of image formation signals (video count).

Embodiment 3

The image forming apparatus in this embodiment is the same in basic structure as that in the first embodiment. Therefore, the general structure of the image forming apparatus in this embodiment will not be described.

The characteristic feature of the image forming apparatus in this embodiment is that, based on the cumulative number of images (copies) made by the image forming apparatus, the number of times the rotational speed of the development sleeve is switched while the image forming apparatus is operated in the intermittent microsecond driving mode, or the length of time the image forming apparatus is to be operated in the intermittent microsecond driving mode. That is, in this embodiment, the greater the cumulative number of the images (copies) made, the greater the number of times the rotational speed of the development sleeve is switched while the image forming apparatus is operated in the development sleeve intermittent microsecond driving mode, and also, the smaller the referential threshold value with which the toner density ratio T/D is compared to start operating the image forming apparatus in the developer sleeve intermittent microsecond driving mode. Given in Table 3 are the number of times the rotational speed of the development roller is to be switched while the image forming apparatus is operated in the intermittent microsecond driving mode. The reason for changing the number of times the rotational speed of the development sleeve is to be switched based on the cumulative number of images (copies) made is that the extent of toner deterioration is roughly proportional to the cumulative length of toner usage, and further, the more deteriorated is the toner, the more likely is the toner to agglomerate, as mentioned in the description of the first preferred embodiment.

TABLE 3

| | T/D Ratio = R (%) | | | | |
|---|---|---|---|---|---|
| | R < 4 | 4 ≦ R < 6 | 6 ≦ R < 8 | 8 ≦ R < 10 | R ≧ 10 |
| 0 < X < 10000 | 0 | 0 | 3 | 6 | 9 |
| 10000 ≦ X < 50000 | 0 | 3 | 5 | 7 | 9 |
| 50000 ≦ X < 100000 | 0 | 4 | 6 | 8 | 10 |
| X ≧ 100000 | 3 | 5 | 7 | 9 | 12 |

X = Number of image formations

By operating the image forming apparatus in the above-described manner, the lumps of toner particles, which result from the agglomeration of toner particles and are likely to stagnate between the development sleeve and development blade, can be more satisfactorily removed regardless of the cumulative length of developer usage (cumulative number of images (copies) made with developer in developing device). Further, the number of times an image forming operation has to be interrupted for the intermittent microsecond driving mode does not need to be significantly increased, and therefore, it is possible to prevent the problem that while an image forming apparatus is used for continuously making a significant number of copies, it gradually reduces in productivity.

Embodiment 4

The image forming apparatus in this embodiment is the same in basic structure as that in the first embodiment, except that it can be operated in two or more processing speeds.

Therefore, the general structure of the image forming apparatus in this embodiment will not be described.

The characteristic feature of the image forming apparatus in this embodiment is that if the image forming apparatus is changed in processing speed, its development sleeve is also changed in rotational speed, and further, the image forming apparatus is changed in the frequency with which it is to be operated in the development sleeve intermittent microsecond driving mode. More concretely, if the development sleeve is reduced in rotational speed, the image forming apparatus is reduced in the frequency with which its image forming operation is interrupted for the intermittent microsecond driving mode.

That is, how well a toner image becomes fixed to recording medium is affected by recording medium properties. Thus, the image forming apparatus in this embodiment is designed so that when a sheet of recording paper which is no less than 129 g/m$^2$ in basis weight is used as recording medium, the process speed is reduced to half the normal speed, and also, the rotational speed of the development sleeve is reduced to half the normal speed. As the speed of the development sleeve is reduced to half the normal speed, the amount by which developer is conveyed through the area between the development sleeve and development blade reduces, which in turn reduces the developer pressure in the area between the development sleeve and development blade, making it therefore less likely for the toner to agglomerate. Thus, when the image forming apparatus is operated at half the normal process speed, the referential (threshold) value, with which the cumulative number of images (copies) made, is compared in Step S5 (FIG. 9) in the first embodiment is doubled in this embodiment.

By designing an image forming apparatus as described above, it is possible to prevent the problem that because an image forming apparatus is operated in the development sleeve intermittent microsecond driving mode more frequently than necessary, the image forming apparatus is unnecessarily reduced in productivity.

As will be evident from the description of the preferred embodiments of the present invention given above, the present invention makes it possible to provide an image forming apparatus which uses two-component developer, more specifically, developer made up of magnetic carrier and non-magnetic toner; simple in structure; and yet, does not output a defective image, the defects of which are attributable to the adhesion of lumps of toner particles resulting from the agglomeration of toner particles, to the regulating member for regulating in thickness the toner layer on the peripheral surface of the developer bearing member.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 141053/2008 filed May 29, 2008 which is hereby incorporated by reference.

What is claimed is:

1. An image forming apparatus comprising:

an image bearing member for bearing an electrostatic latent image;

a rotatable developer carrying member, provided opposed to said image bearing member, for carrying a developer including toner and a carrier to a position where said developer carrying member is opposed to said image bearing member;

a regulating member for regulating the amount of the developer to be carried on said developer carrying member;

a driving device for rotating said developer carrying member;

a controller for controlling said driving device to execute, at the time of an end of an image formation operation, a plurality of continuous operations, each continuous operation including acceleration of a rotational speed of said developer carrying member and deceleration thereof following the acceleration.

2. An apparatus according to claim 1, wherein a rotational direction of said developer carrying member is unchanged in each continuous operation.

3. An apparatus according to claim 1, wherein said controller controls said driving device such that rotation of said developer carrying member intermittently stops.

4. An apparatus according to claim 1, further comprising a developer container, which accommodates said developer carrying member, for containing the developer to be supplied to said developer carrying member, wherein said controller executes each continuous operation when an average of a weight ratio of the toner to the developer in said developer container during a series of image formation operations is not less than a predetermined ratio, and each continuous operation is not executed otherwise.

5. An apparatus according to claim 1, wherein said controller increases a number of switches of the rotational speed of said developer carrying member during each continuous operation, with an increase of an average of a weight ratio of the toner to the developer in said developer container during a series of image formation operations.

6. An apparatus according claim 4, wherein said controller increases a duration of each continuous operation, with an increase of an average of the weight ratio of the toner to the developer in said developer container during a series of image formation operations.

7. An apparatus according to claim 1, wherein said controller increases a frequency of the plurality of continuous operations with an increase of usage of the developer.

8. An apparatus according to claim 1, wherein said controller increases a number of switches of the rotational speed of said developer carrying member with an increase of usage of the developer.

9. An apparatus according to claim 1, wherein said controller increases a duration of each continuous operation with an increase of usage of the developer.

10. An apparatus according to claim 9, wherein the usage of the developer is represented by an integrated number of image formations.

* * * * *